United States Patent [19]

Eriksson

[11] Patent Number: 4,653,409

[45] Date of Patent: Mar. 31, 1987

[54] APPARATUS FOR REGULATING AND CLEANING AN AIR PASSAGE IN THE WALL OF A FURNACE

[75] Inventor: Tore I. Eriksson, Skutskär, Sweden

[73] Assignee: LT-Produkter Skutskar AB, Skutskar, Sweden

[21] Appl. No.: 824,593

[22] Filed: Jan. 31, 1986

[30] Foreign Application Priority Data

Feb. 13, 1985 [SE] Sweden ..... 8500668

[51] Int. Cl.[4] ..... F23L 5/00

[52] U.S. Cl. ..... 110/182.5; 122/6.6; 122/235 B; 122/379

[58] Field of Search ..... 110/182.5; 122/6.5, 122/6.6, 235 B, 379, 390, 392; 15/316 R; 134/166 R, 166 C, 169 R, 169 C

[56] References Cited

U.S. PATENT DOCUMENTS

| | | | |
|---|---|---|---|
| 3,742,916 | 7/1973 | Wessburg et al. | 110/182.5 X |
| 3,875,904 | 4/1975 | Astrom | 122/379 X |
| 3,900,011 | 8/1975 | Stenlund | 122/235 B |
| 3,943,861 | 3/1976 | Astrom et al. | 110/182.5 |
| 4,027,604 | 6/1977 | Jansson | 122/235 B X |
| 4,099,471 | 7/1978 | Sander et al. | 110/182.5 |
| 4,545,308 | 10/1985 | Zateska | 122/379 X |

FOREIGN PATENT DOCUMENTS 7513171 9/1978 Sweden .

*Primary Examiner*—Albert J. Makay
*Assistant Examiner*—Steven E. Warner
*Attorney, Agent, or Firm*—Harness, Dickey & Pierce

[57] ABSTRACT

An apparatus for regulating and cleaning air passages (4) provided in the side-wall of a furnace, such as a soda recovery boiler, and connected to an air box positioned outside the wall, comprising a sleeve member reciprocatably mounted in the air box and insertable into the air passage. The rear opening of the sleeve member connects to and is supported by a hollow section of an elongate holder which is slidably mounted in the longitudinal direction thereof and extends through the wall of the air box, and which holder is operatively connected to a driving device. The hollow section of the holder comprises at least one air inlet. In a first regulating position of the sleeve member the air inlet is within a housing member partially surrounding the hollow section to thereby substantially prevent the admission of air into the air inlet, while in a second, advanced position of the sleeve member the air inlet is at least partially outside the housing member so that air in the air box is permitted to flow through the air inlet into the sleeve member. In a modified embodiment the apparatus comprises a separate air regulating device in the form of a case member which is slidably mounted along and in an encompassing relationship with the sleeve member and holder.

19 Claims, 4 Drawing Figures

APPARATUS FOR REGULATING AND CLEANING AN AIR PASSAGE IN THE WALL OF A FURNACE

The present invention relates to an improved apparatus for regulating and cleaning the combustion air supply passages provided in the walls of furnaces, particularly refuse burning furnaces such as soda recovery boilers and the like.

In the cellulose industry the waste liquor from the processing of cellulose pulp (sulphate waste liquor and in some cases sulphite waste liquor) is burnt for recovery purposes in a recovery boiler. Due to the nature of the fuel and the process conditions the passages in the furnace walls through which the combustion air is supplied tend to be clogged by dust particles and flowing slag products which causes a non-uniform and incomplete combustion. The air passages are usually provided with some kind of regulating means which to reduce said problem in a hitherto widely used type are designed as regulating sleeves mounted in the air passages and having a corresponding shape thereto but a somewhat smaller dimension, such that the air is forced to flow into the furnace through the gap provided between the regulating sleeve and the air passage and thereby blowing the air passage clean. The amount of air supplied will depend on the extent to which the regulating sleeve is introduced into the air passage, which often widens outwardly from the combustion room. The cleanblowing effect obtained is, however, not always sufficient to keep the air passages clean, but it has been necessary to occasionally also remove the cloggings mechanically. In addition to simple manual poking through and/or beside the regulating sleeves with a lance or the like, this has also been achieved by designing the regulating sleeves to permit "poking" therewith by, when necessary or automatically with suitable intervals, pushing them forward from their regulating position such that the inner ends thereof extend into the furnace.

Examples of various arrangements for such air passage regulating and cleaning arrangements are described, for example, in the U.S. Pat. Nos. 3,742,916; 3,875,904; 3,900,011; 3,943,861 and 4,027,604; and the Swedish Pat. No. 7513171-4. The practical realization of such and similar principles, have, however, resulted in apparatuses which, in addition to having a complex and expensive design, have been unsatisfactory with regard to the operation thereof as well as from the viewpoint of maintenance.

The purpose of the present invention is to eliminate the disadvantages of the prior art apparatuses and to provide an improved and reliable regulating/cleaning apparatus having a simple construction and which is easy to service and repair. Such a regulating and cleaning apparatus has the features stated in the annexed claims.

The invention will hereinafter be described in more detail with regard to some particular, non-limiting embodiments thereof, reference being made to the accompanying drawings, wherein FIG. 1 is a schematic longitudinal sectional view of an embodiment of the apparatus of the present invention;

Figure 1:
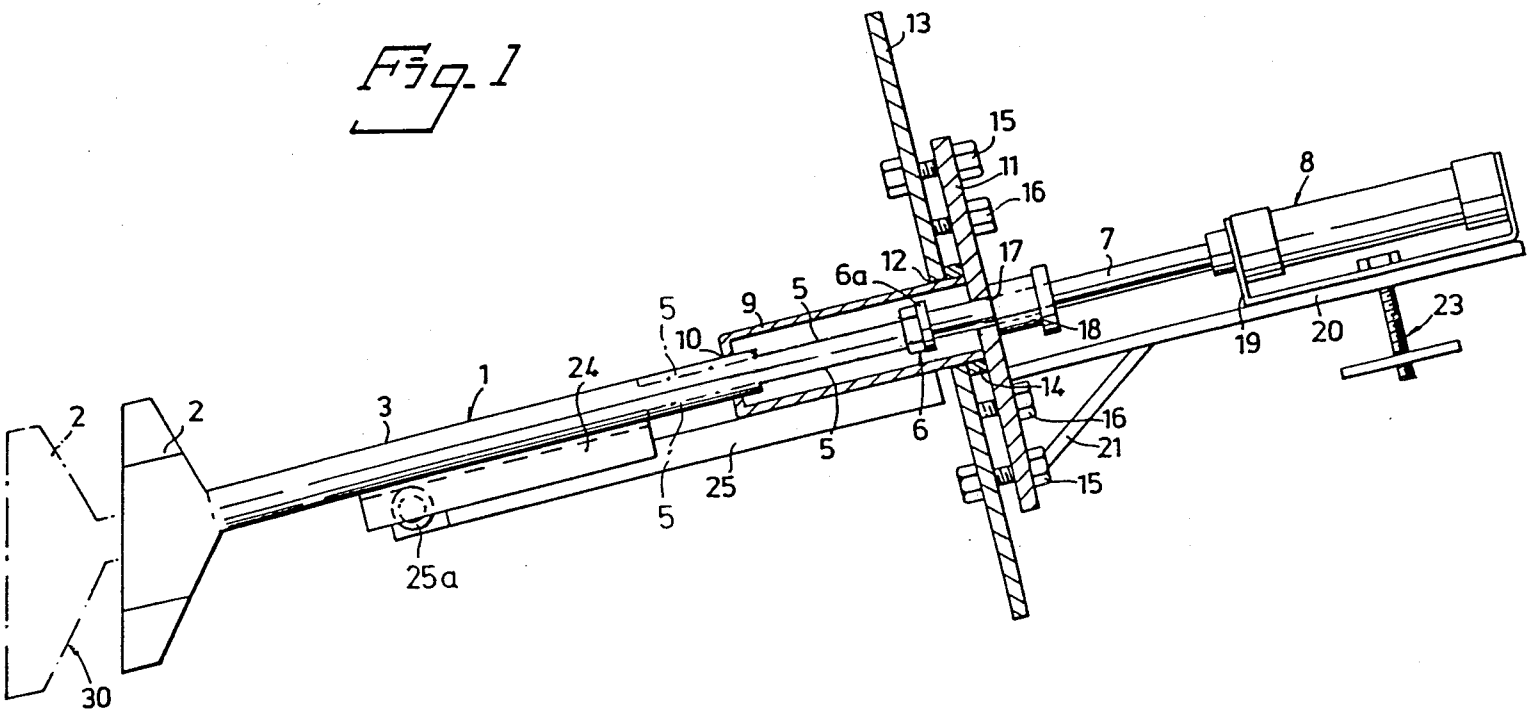
Figure 2:
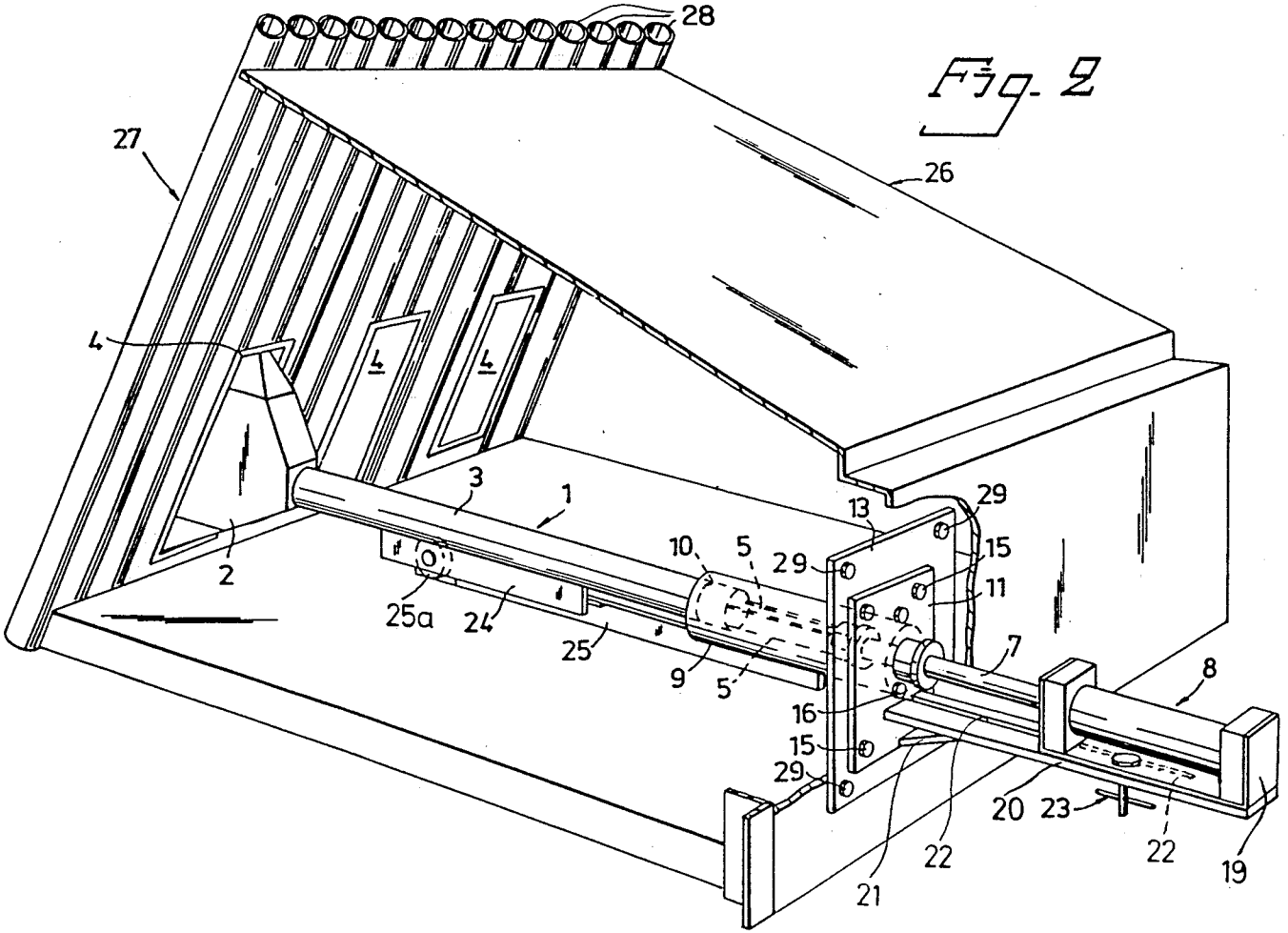
FIG. 2 is a schematic and partially transparent perspective view of the apparatus shown in FIG. 1 mounted to an air passage of a soda recovery boiler wall.

The regulating/cleaning apparatus of FIGS. 1 and 2, generally designated by the reference numeral 1, comprises an open regulating sleeve 2 attached to the fore end of a tube 3. The regulating sleeve 2 widens from the point of connection with the tube 3 vertically as well as laterally to an open front portion having a shape substantially corresponding to but of a dimension which is somewhat smaller than the air passage 4 (FIG. 2) it is designed to regulate and clean. In the opposite or rear section thereof (to the right in FIGS. 1 and 2) the tube 3 has one or more air holes, e.g., in the form of one or more longitudinal rows of apertures or, as illustrated, two opposite slots 5. The rear end of the tube 3 is rigidly connected to the end of a, possibly extended, piston rod 7 of a pneumatic piston/cylinder assembly 8 by suitable fixing means 6. In the illustrated case, e.g., the end of the piston rod 7 is threaded and screwed into the threaded bore of a plate 6*a* attached to the tube 3 and secured by a locking nut.

In FIG. 1 the perforated tube section is located within a surrounding cylinder-shaped housing 9, the fore end of which has an opening 10 to receive the tube 3. The cylinder housing 9 is at the rear end thereof attached to a base plate 11 and fitted through an opening 12 in a mounting plate 13 for the whole apparatus 1. A sealing ring 14 is provided around the cylinder housing 9 between the base plate 11 and the mounting plate 13. The base plate 11 is fixed to the mounting plate 13 by means of bolting 15, and the position of the base plate 11, i.e. the spacing and angle in relation to the mounting plate 13, is adjustable by means of adjusting screws 16 such that the position of the regulating sleeve 2 in relation to the air passage 4 may be accurately adjusted. The piston rod 7 extends through an opening 17 of the base plate 11 and further through a stuffing box 18 attached to the plate and sealing the lead-through.

The piston/cylinder assembly 8 is supported by a bracket 19 attached to a flat bar 20 which in turn is fixed to the base plate 11 with the support of a brace 21. As will be described further below the piston/cylinder assembly 8 is movable in the longitudinal direction thereof along said flat bar 20 and may be secured in any desired position by means of a locking screw 23 extending through a central longitudinal slot 22 (FIG. 2) in the flat bar 20 and capable of clamping the bracket 19 thereto. Instead of said slot 22 cooperating with said locking screw 23 other guide means may, of course, be provided. E.g., bracket 19 could comprise a guide member at the underside thereof which at least partially encompasses the bar 20, such as a slidable sleeve member.

The tube 3 with the regulating sleeve 2 may thus be moved in the longitudinal direction thereof in relation to the stationary unit formed by the mounting plate 13 with the attached base plate 11 and the housing cylinder 9. This may be effected either by manual displacement of the piston/cylinder assembly 8 after loosening the locking screw 23, or mechanically by the movement of the piston rod 7 on actuation of the assembly 8 as will be further described below. Appropriate guiding means are provided for guiding the movement of the tube 3, in the illustrated case a guide rail 24 in the form of an inverted channel attached to the underside of the tube 3 and engaging a support member, such as a flat bar 25 which extends along a part of the tube 3 and is fixed to the underside of the housing cylinder 9, e.g., by welding. Slidability is ensured by means of a ball bearing 25*a* fixed to a fork-shaped extension of said flat bar 25. Depending on the extension and/or structure of the housing 9 the support and guide members 24, 25 may be omitted, the housing 9 providing the necessary supporting and guiding action.

When the piston/cylinder assembly 8 is actuated the tube slots 5 are brought out from the cylinder housing 9 and exposed to the surrounding air such that air may be admitted through the openings 5 and via the interior of the tube 3 to the regulating sleeve 2.

It is, of course, not necessary for the tube 3 as well as the housing cylinder 9 to have a circular cross-section, but they may as well have any other suitable section, e.g., rectangular. Thus, as used herein the terms "tube" and "tubular" are to be interpreted in a broad sense and are not meant to be restricted to the cylindrical form.

FIG. 2 shows the regulating/cleaning apparatus 1 mounted in an air box 26 which in conventional manner is arranged along the wall 27 of a refuse burning furnace, such as a soda recovery boiler. The illustrated furnace wall 27 is built up by water carrying tubes 28. At suitable positions adjacent tubes 28 are bent apart to form said air passages 4. The mounting plate 13 of the regulating/cleaning apparatus 1 is attached over a corresponding opening of the air box 26 which permits the passage of the regulating sleeve 2. Suitably an inspection window, not shown, is arranged in or in connection with the mounting plate 13. An apparatus 1 is correspondingly provided at each air passage 4 in the furnace wall.

In operation the sleeve 2 is adjusted to a suitable position in relation to the air passage 4 to obtain the desired flow of air through the passage 4. This is effected by undoing the locking screw 23 of the piston/-cylinder assembly 8 and displacing it as desired along the slot 22 of the flat bar 20, thereby moving the assembly 8 together with the piston rod 7, the tube 3 and the sleeve 2. An appropriate setting scale (not shown) is suitably provided on the bracket 20. Instead of using the locking screw 23 as a handle in said adjustment, a separate handle may be provided on the bracket 19.

For cleaning operation the piston/cylinder assembly 8 is actuated to push the sleeve 2 forward, as is indicated by the sleeve position illustrated by dashed lines at 30 in FIG. 1. The cleaning stroke is preferably adjusted such that the fore edge of the sleeve 2 will extend beyond the furnace side edge of the air passage 4 only to such an extent as is necessary for efficient removal of the deposit so that as small a part as possible of the sleeve is exposed to down-flowing and splashing slag products in the combustion room. Such poking with the sleeve 2 is suitably effected automatically with predetermined intervals under the control of any suitable control device (not shown) for the piston/cylinder assembly 8.

When the sleeve 2 is in its poking position and thus is completely inserted into the air passage 4 and substantially blocking the same, air supply from the air box 26 to the furnace space is ensured by the slot openings 5 of the tube 3 which then have been moved out of the housing 9 such that air is admitted through the openings 5 and via the tube 3 and the interior of the sleeve 2 into the furnace. When the sleeve 2 is retracted to its regulating position the air openings 5 are again moved into the housing 9 and the air supply via the openings 5 is thereby substantially prevented.

If desired, also manual poking may be performed as mentioned above. This is effected by actuating the piston/cylinder assembly 8 to move the sleeve 2 to the poking position thereof, whereupon the locking screw 23 is undone and the assembly 8 is manually reciprocated along the flat bar 20.

The regulating/cleaning apparatus 1 shown in FIGS. 1 and 2 is very simple to remove when necessary, e.g. for replacement or repair. In such a case it is only necessary to undo the screws 29 which secure the mounting plate 13 to the side wall of the air box 26. The whole apparatus may then easily be taken out through the exposed opening of the side wall.

Figure 3:
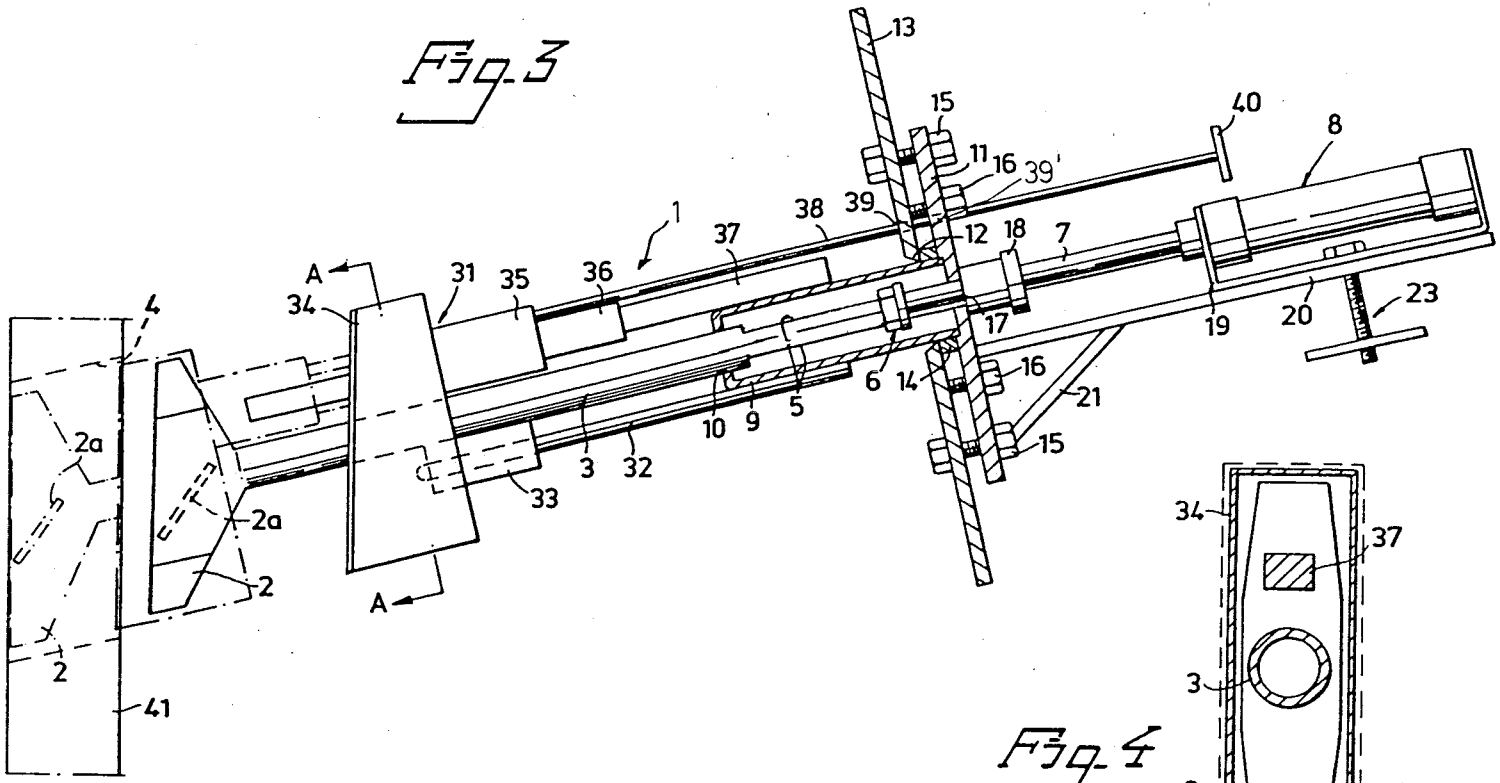
FIG. 3 is a modified variation of the embodiment shown in FIG. 1.
Figure 4:
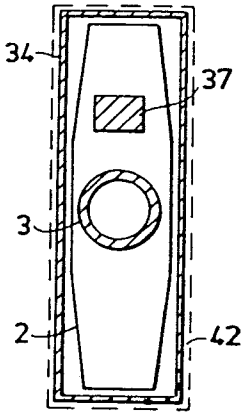
FIG. 4 is a sectional view along the line A—A in FIG. 3.

In FIGS. 3 and 4 a further development of the apparatus according to FIGS. 1 and 2 is illustrated, wherein the latter has been supplemented with a separate air regulating device 31, as will be described in more detail below. Otherwise the embodiment of FIG. 3 corresponds to that of FIGS. 1 and 2 (the same reference numerals being used for like parts) except that the sliding mounting 24, 25, 25*a* of the tube 3 shown in FIGS. 1 and 2 has been replaced by a round bar 32 attached to the housing 9 and extending through a sleeve or block member 33 which is fixed to the tube 3 and internally lined with a low friction material, such as Teflon® (polytetrafluoroethylene plastic). (Similarly as for the embodiment of FIG. 1 the bar 32 and the block member 33 may be omitted). Further, the sleeve member 2 is here internally provided with an oblique plate or sheet 2*a* for guiding the air supplied through the tube 3 to the sleeve 2.

The air regulating means 31 comprises a sleeve or casing 34 surrounding the tube 3 and adapted to be brought over the sleeve 2, as is shown by the dashed position in FIG. 3. The air regulating casing 34 is supported by a U-shaped bracket member 35 to which a sleeve member 36, in the illustrated case a square tube piece, is attached, which in turn is displaceably mounted to a guide bar 37 fixed to the cylinder housing 9 in any suitable manner, e.g., by welding. Further, a regulating or throttling arm 38 is attached to said square tube 36 and said bracket member 35, respectively, and extends through borings 39 and 39' of the mounting plate 13 and the base plate 11, respectively, such that it may be operated from the outside of the air box 26 by a handle 40. Suitable means (not shown) are provided for securing the casing 34 in the desired position along the apparatus 1, e.g., appropriate jags in the throttling arm to cooperate with the bores 39, 39' or locking screw means to permit infinitely variable adjustment of the casing position.

When using the modified apparatus shown in FIGS. 3 and 4 the sleeve member 2 is positioned at some distance from the furnace wall, here designated by 41, since the sleeve 2 is here primarily utilized for cleaning the air passage 4 by poking as described above. The air supply through the air passage 4 is instead separately controlled by the regulating sleeve or casing 34, which, depending on its configuration and dimension, may be positioned immediately outside or possibly slightly introduced into the air passage, as is shown by the dashed position in FIG. 3, such that a desired air flow through the air passage is obtained. The casing 34 has such dimensions that it closely surrounds the sleeve 2 (see FIG. 4) to force the air to pass substantially externally of the casing into the air passage, whereby the desired slit-shaped flow may be obtained. Thus, in its air regulating position the casing 34 at least partially surrounds the sleeve 2 which for cleaning operation may be inserted into the air passage 4 in the same way as for the embodiment of FIGS. 1 and 2 (indicated by dashed lines). In FIG. 4 it is indicated that the casing 34 optionally may be slightly flanged outwards to stiffen the structure and possibly adapt it to the air passage opening 4.

There are several advantages of using a separately controllable air regulation means according to the above. In addition to improved possibilities of choking the air flow, and thereby a possibility to maintain the pressure even at low charge, the sleeve 2 may be made smaller with the resulting reduced risk of jamming in the air passage. Further, since the sleeve 2 is not used for air regulation it may in its normal position be kept suitably spaced from the furnace wall 4 to permit easy inspection of the air passage through the above inspection window, possibly after retraction of the air regulating casing 34.

The invention is, of course, not restricted to the above described and particularly shown embodiments, but many modifications and changes are possible within the scope of the general inventive concept as it is defined in the subsequent claims. For example, the regulating/cleaning apparatus may be used in other furnaces than soda recovery boilers where similar problems are encountered.

What is claimed is:

1. An apparatus for regulating and cleaning an air passage provided in the wall of a furnace, such as a soda recovery unit, and communicating with an air box positioned outside said wall, said apparatus comprising:

a sleeve member having a fore and a rear opening and which is insertable into said air passage to remove deposits therefrom, an elongate holder means supporting said sleeve member, which holder means is mounted to be slidable in its longitudinal direction and extends through the wall of said air box opposite said air passage, said holder means comprising a hollow air conduit section connected to the rear opening of said sleeve member and which spaced from said sleeve member is provided with at least one air inlet, a stationary housing member within said air box disposed in telescopic sliding relationship with the end portion of said hollow section of the holder means and guidably supporting said holder means in all longitudinal slidable positions thereof, and driving means operatively connected to said holder means for imparting a reciprocatory movement thereto and thereby to said sleeve member, said housing member being arranged such that, in a first, air regulating position of the sleeve member, said at least one air inlet is within said housing member to thereby substantially prevent the admission of air from said air box to said air inlet, and, in a second, advanced cleaning position of the sleeve member, said at least one air inlet is at least partially outside said housing member to permit air from the air box to pass through said air inlet and into said sleeve member.

2. The apparatus of claim 1, wherein said housing member is sleeve-shaped and projects from the air box wall opposite said air passage.

3. The apparatus of claim 1, wherein said air inlet is at least one peripheral hole.

4. The apparatus of claim 1, wherein said housing member is attached to a base plate removably mounted to said mounting plate, said housing member being fitted into an aperture of said mounting plate, and the spacing and angle of said base plate to said mounting plate being adjustable.

5. The apparatus of claim 1, wherein said driving means is a piston-cylinder assembly.

6. The apparatus of claim 1, wherein said sleeve member, said holder means, said housing member and said driving means form an assembly supported by a mounting plate which is arranged to be mounted over a corresponding opening in the wall of said air box opposite said air passage.

7. The apparatus of claim 6, wherein said holder means at a fore part thereof is slidably supported by a stationary support member extending along the holder means.

8. The apparatus of claim 1, wherein said driving means is displaceably arranged relative to the wall of said air box to permit adjustable setting of the position of said sleeve member in relation to said air passage and to optionally permit manual poking into the air passage with said sleeve member.

9. The apparatus of claim 2, wherein said driving means is slidably supported by a holder member projecting from said base plate, and wherein locking means are provided for securing the driving means in desired positions along said holder member.

10. An apparatus for regulating and cleaning an air passage provided in the wall of a furnace, such as a soda recovery unit, and communicating with an air box positioned outside said wall, said apparatus comprising:

a sleeve member having a fore and a rear opening and which is insertable into said air passage to remove deposits therefrom, an elongate holder means supporting said sleeve member, which holder means is mounted to be slidable in its longitudinal direction and extends through the wall of said air box opposite said air passage, said holder means comprising a hollow air conduit section connected to the rear opening of said sleeve member and which spaced from said sleeve member is provided with at least one air inlet, a case member which is separately slidable and adjustable along and over said holder means and sleeve member and arranged to, optionally in combination with said sleeve member, regulate the air flow through said air passage, a stationary housing member within said air box disposed in telescopic sliding relationship with the end portion of said hollow section of the holder means, and driving means operatively connected to said holder means for imparting a reciprocatory movement thereto and thereby to said sleeve member, said housing member being arranged such that, in a first position of the sleeve member, said at least one air inlet is within said housing member to thereby substantially prevent the admission of air from said air box to said air inlet, and, in a second, advanced cleaning position of the sleeve member, said at least one air inlet is at least partially outside said housing member to permit air from the air box to pass through said air inlet and into said sleeve member.

11. The apparatus of claim 10, wherein said case member is slidably mounted to a support member extending along said holder means and fixed to said housing member.

12. The apparatus of claim 10, wherein said housing member is sleeve-shaped and projects from the air box wall opposite said air passage.

13. The apparatus of claim 10, wherein said air inlet is at least one peripheral hole.

14. The apparatus of claim 10, wherein said housing member is attached to a base plate removably mounted to said mounting plate, said housing member being fitted into an aperture of said mounting plate, and the spacing and angle of said base plate to said mounting plate being adjustable.

15. The apparatus of claim 10, wherein said driving means is a piston-cylinder assembly.

16. The apparatus of claim 10, werein said sleeve member, said holder means, said housing member and said driving means form an assembly supported by a mounting plate which is arranged to be mounted over a corresponding opening in the wall of said air box opposite said air passage.

17. The apparatus of claim 16, wherein said holder means at a fore part thereof is slidably supported by a stationary support member extending along the holder means.

18. The apparatus of claim 10, wherein said driving means is displaceably arranged relative to the wall of said air box to permit adjustable setting of the position of said sleeve member in relation to said air passage and to optionally permit manual poking into the air passage with said sleeve member.

19. The apparatus of claim 18, wherein said driving means is slidably supported by a holder member projecting from said base plate, and wherein locking means are provided for securing the driving means in desired positions along said holder member.

* * * * *